US005975851A

United States Patent [19]

Liang

[11] Patent Number: 5,975,851

[45] Date of Patent: Nov. 2, 1999

[54] TURBINE BLADE WITH TRAILING EDGE ROOT SECTION COOLING

[75] Inventor: George P. Liang, Palm City, Fla.

[73] Assignee: United Technologies Corporation, Hartford, Conn.

[21] Appl. No.: 08/993,023

[22] Filed: Dec. 17, 1997

[51] Int. Cl.[6] ..... F01D 5/18

[52] U.S. Cl. ..... 416/97 R; 415/115

[58] Field of Search ..... 415/115; 416/96 R, 416/96 A, 97 R

[56] References Cited

U.S. PATENT DOCUMENTS

| | | | |
|---|---|---|---|
| 3,533,711 | 10/1970 | Kercher | 416/97 R X |
| 3,628,885 | 12/1971 | Sidenstick et al. | 416/97 R |
| 4,604,031 | 8/1986 | Moss et al. | 416/97 R |
| 4,767,268 | 8/1988 | Auxier et al. | 416/97 R |
| 4,820,122 | 4/1989 | Hall et al. | 416/97 R |
| 5,203,873 | 4/1993 | Corsmeier et al. | 416/96 A |
| 5,387,085 | 2/1995 | Thomas, Jr. et al. | 416/97 R |
| 5,403,159 | 4/1995 | Green et al. | 416/97 R |
| 5,462,405 | 10/1995 | Hoff et al. | 416/97 R |
| 5,591,007 | 1/1997 | Lee et al. | 416/97 R |
| 5,599,166 | 2/1997 | Deptowicz et al. | 416/97 R |
| 5,700,131 | 12/1997 | Hall et al. | 416/97 R |
| 5,741,117 | 4/1998 | Clevenger et al. | 416/97 R X |
| 5,857,837 | 1/1999 | Zelesky et al. | 416/97 R |

FOREIGN PATENT DOCUMENTS

| | | | |
|---|---|---|---|
| 57-13201 | 1/1982 | Japan | 416/97 R |

*Primary Examiner*—John E. Ryznic
*Attorney, Agent, or Firm*—Christopher T. Hayes

[57] ABSTRACT

A convectively cooled turbine blade has two distinct cooling air passage systems. The first system cools the blade leading edge and emits cooling air through outlet passageways in the leading edge arranged in showerhead array. The second system includes a five-pass series flow passage comprising five cooling passage sections that extend in series through the remainder of the blade. One of the passage sections includes a plurality of recesses near the trailing edge of the turbine blade to retain cooling air flow to the trailing edge adjacent the root portion of the blade.

4 Claims, 2 Drawing Sheets

TURBINE BLADE WITH TRAILING EDGE ROOT SECTION COOLING

This invention was made under a U.S. Government contract and the Government has rights herein.

FIELD OF THE INVENTION

This invention relates in general to turbine blades and deals more particularly with an improved convectively cooled turbine blade particularly adapted for use in the first stage of a gas turbine engine.

BACKGROUND OF THE INVENTION

In gas turbine engines a turbine operated by combustion product gases drives a compressor which furnishes air to a burner. Gas turbine engines operate at relatively high temperatures, and the capacity of such an engine is limited to a large extent by the ability of the turbine blades to withstand the thermal stresses that develop at such relatively high operating temperatures. The ability of the turbine blades to withstand such thermal stresses is directly related to the materials from which the blades are made, and the material's strength at high operating temperatures.

A turbine blade includes a root portion at one end and an elongated blade portion which extends from the root portion. A platform extends outwardly from the root portion at the junction between the root portion and the blade portion. To enable higher operating temperatures and increased engine efficiency without risk of turbine blade failure, hollow, convectively cooled turbine blades are frequently utilized.

Such turbine blades generally have intricate interior passageways which provide torturous, multiple pass flow paths to assure efficient cooling that are designed with the intent that all portions of the turbine blades may be maintained at relatively uniform temperature. However, due to the centrifugal and boundary layer effects on the cooling air as it flows through the interior passageways, areas of the turbine blade which should be convectively cooled may be inadequately cooled. This inadequate cooling can result in local "hot spots" in the turbine blade where the turbine blade material is exposed to temperatures that can damage the turbine blade so as to significantly reduce the useful life of the turbine blade. If such a hot spot should occur in the blade portion of the turbine blade adjacent the root portion of the blade near the blade platform, cracks can begin to develop at the hot spot.

During engine operation, high stresses occur in the turbine blade at the junction of the blade portion and the root portion, and in particular at the trailing edge of the blade portion due to the relatively small thickness of the blade portion at that location. Any crack that occurs in the trailing edge near the root portion may propagate rapidly across the blade portion during engine operation, liberating the blade portion of the turbine blade. A blade portion so liberated can lead to severe damage, or in some cases destruction, of the engine.

What is needed is a turbine blade which prevents such hot spots from developing in the trailing edge of the blade portion at the blade platform.

SUMMARY OF THE INVENTION

It is therefore an object of the present invention to provide a turbine blade which prevents hot spots from developing in the trailing edge of the blade portion at the blade platform.

Accordingly, the present invention discloses a convectively cooled turbine blade has two distinct cooling air passage systems. The first system cools the blade leading edge and emits cooling air through outlet passageways in the leading edge arranged in showerhead array. The second system includes a five-pass series flow passage comprising five cooling passage sections that extend in series through the remainder of the blade. One of the passage sections includes a plurality of recesses near the trailing edge of the turbine blade to retain cooling air flow to the trailing edge adjacent the root portion of the blade.

The foregoing and other features and advantages of the present invention will become more apparent from the following description and accompanying drawings.

DETAILED DESCRIPTION OF PREFERRED EMBODIMENT

Figure 2:
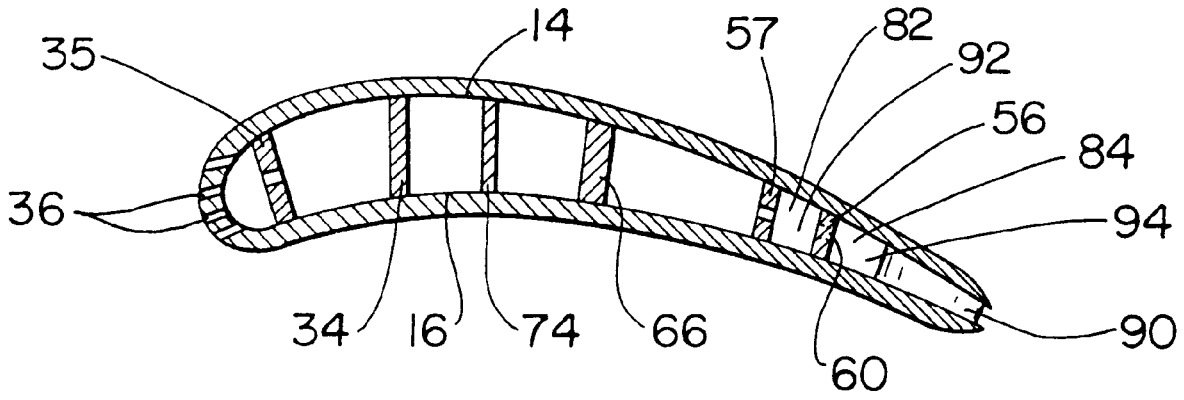
FIG. 2 is a cross-sectional view taken along the line 2—2 of FIG. 1.

Turning now to the drawing, the invention is illustrated and described with reference to an air cooled turbine blade, designated generally by the numeral 10, and particularly adapted for use in the first stage of an axial flow gas turbine engine (not shown) which has a plurality of airfoil shaped turbine rotor blades mounted in angularly spaced relation on a rotor disc. The turbine blade 10 has a more or less conventional outer configuration and comprises a hollow elongated body, indicated generally at 12, which includes a concave inner side wall 14 and an opposing convex inner side wall 16 as shown in FIG. 2. The side walls terminate at longitudinally extending leading and trailing edges indicated, respectively at 18 and 20.

The body 12 further includes a root portion 22 at one end 33 and an elongated blade portion 24 which extends from the root portion 22 and terminates at a closed tip 26 at the other end 27 of the blade 10. A platform 28 extends outwardly from the body at the junction 49 between the root portion 22 and the blade portion 24. The root portion 22 is preferably provided with attachment shoulders (not shown) which may have a conventional fir tree configuration for mounting the turbine blade 10 in complementary slots in a rotor disc.

In accordance with the present invention, two distinct cooling air passageway systems are provided for convectively cooling the blade 10. The first passageway system 30, includes a substantially straight longitudinally extending first passage 32 which opens through the root end 33 of the blade 10 and extends through the root portion 22 and into the blade portion 24 along the leading edge 18. A first root rib 31 extends from the root end 33 toward the blade portion 24, and a first blade rib 34 disposed between the side walls 14 and 16 extends from the tip end 27 to the first root rib 31.

Figure 1:
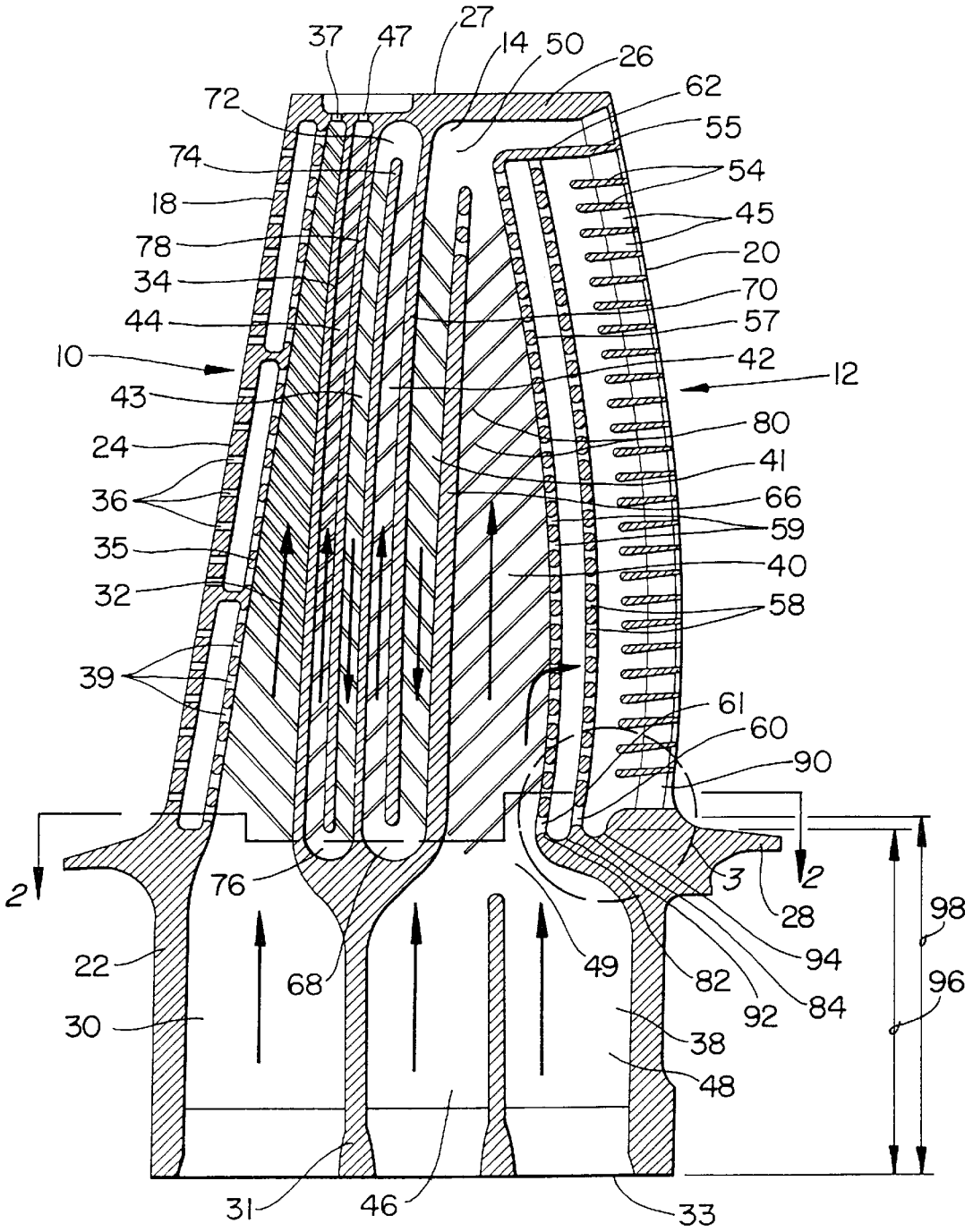
FIG. 1 is a longitudinal sectional view of an airfoil shaped turbine blade embodying the present invention.

The first blade rib 34 is integral with the first root rib 31, and together the first root rib 31 and the first blade rib 34 define, in part, the first passage 32 as shown in FIG. 1. The first fluid passageway system 30 is separated from the second fluid passageway system 38 by the first root rib 31 and the first blade rib 34. The first passage includes a leading edge impingement rib 35 that extends from the rib portion 22 to the tip 26.

The leading edge impingement rib 35 includes a plurality of impingement holes 39 for allowing air to pass therethrough. At least one longitudinally spaced series of fluid outlet passages 36 extend through the leading edge 18 and communicate with the first passage 32 through the impingement holes 39. The fluid outlet passages 36 terminate in a showerhead array of passage openings in the leading edge 18. The first passage 32 terminates within the blade portion 24 adjacent the tip 26, and a first tip orifice 37 opens into the tip end 27 and extends through the tip 26 and into the first passage 32 of the first fluid passageway system 30.

The turbine blade 10 further includes a second distinct passageway system 38 which generally comprises a plurality of longitudinally extending and series connected passage sections 40, 41, 42, 43, 44 which provide a five-pass flow passage through the remainder of the blade portion 24. The five-pass flow passage includes two pathways: a first pathway that extends from the root end 33 along the blade portion 24 adjacent the trailing edge 20 to a second tip orifice 47 that opens through the tip 26 into the tip end 27, and a second pathway that extends between the root end 33 of the turbine blade 10 and a longitudinally spaced series of pedestal slots 45 that open through the trailing edge 20 and are defined by a longitudinally spaced series of elongated pedestal members 54 disposed between the side walls 14, 16. The pedestal slot nearest the root end 33 defines a root pedestal slot 90. The passageway system 38 further includes two inlet branch passages 46 and 48 which are disposed within the root portion 22 and open through the root end 33 of the turbine blade 10.

Referring again to FIG. 1, the first passage section 40 extends along the trailing edge 20, and a plurality of branch passages 46, 48 in the root portion 22 open through the root end 33 and merge with each other and with the first passage section 40 at the junction 49 between the root portion 22 and the blade portion 24. The pedestal immediately adjacent the tip end 27 defines a tip pedestal 55. The first passage section 40 includes first and second impingement ribs 56, 57, and each of these impingement ribs 56, 57 extends from the root portion 22 to the tip pedestal 55.

The first impingement rib 56 is in spaced relation to the second impingement rib 57, and each of the impingement ribs includes a plurality of impingement holes 58, 59 for allowing air to pass therethrough. The impingement hole nearest the root end 33 in the first impingement rib 56 defines a first root impingement hole 60, and the impingement hole nearest the root end 33 in the second impingement rib 57 defines a second root impingement hole 61. A first root wall 82 extends between the first root impingement hole 61 of the second impingement rib 57 and the root impingement hole 60 of the first impingement rib 56, and a second root wall 84 extends between the root impingement hole 60 of the first impingement rib 56 and the root pedestal slot 90. The impingement hole in the first impingement rib 56 nearest the tip pedestal 55 defines a tip impingement hole 62. Each of the impingement holes 58 between the root impingement hole 60 and the tip impingement hole 62 in the first impingement rib 56 is aligned with one of the pedestals 54 to impinge cooling air thereon. Each of the impingement holes 59 between the root impingement hole 61 and the tip pedestal 55 in the second impingement rib 57 is aligned with one of the pedestal slots 45 so as to impinge cooling air upon the first impingement rib 56.

A second passage section 41 adjacent the first passage section 40 is connected thereto at a first outer turning region 50 adjacent the tip end 27. The second passage section 41 is separated from the first passage section 40 and from the two branch passages 46, 48 by a second blade rib 66 connected to the first root rib 31 at the junction 49. The second blade rib 66 and extends toward the tip end 27 in generally parallel relation to the first blade rib 34 and terminates in spaced relation to the tip 26 at the first outer turning region 50.

A third passage section 42 adjacent the second section 41 is connected thereto at a first inner turning region 68 proximate the junction 49. The third passage section 42 is separated from the second passage section 41 a third blade rib 70 extending from the tip 26 toward the root end 33 in generally parallel relation to the second blade rib 66. The third blade rib 70 terminates in spaced relation to the first root rib 31 at the first inner turning region 68.

A fourth passage section 43 adjacent the third section 42 is connected thereto at a second outer turning region 72 adjacent the tip 26. The fourth passage section 43 is separated from the third passage section 42 by a fourth blade rib 74. The fourth blade rib 74 is connected to the first root rib 31 at the junction 49 and extends toward the tip 26 in generally parallel relation to the third blade rib 70. The fourth blade rib 74 terminates in spaced relation to the tip 26 at the second outer turning region 72.

A fifth passage section 44 adjacent the fourth section 43 is connected thereto at a second inner turning region 76 proximate the junction 49. The fifth passage section 44 is separated from the fourth passage section 43 by a fifth blade rib 78. The fifth blade rib 78 extends from the tip 26 toward the root end 33 in generally parallel relation to the fourth blade rib 74. The fifth blade rib 78 terminates in spaced relation to the first root rib 31 at the second inner turning region 76. The fifth passage section 44 terminates within the blade portion 24 adjacent the tip 26.

Air flows into and through the turbine blade 10 from the rotor disc and in directions indicated by the flow arrows in FIG. 1. More specifically, cooling air from the rotor disc enters the first passageway system 30, flows outwardly through the passage 32, flows through the leading edge impingement rib 35 and is eventually discharged at the blade leading edge through the showerhead holes 36. Additional air from the rotor disc enters the branch passages 46 and 48 which comprises the second passageway system 38 and flows into and through the first passage section 40 between the second blade rib 66 and the second impingement rib 57. As shown in FIG. 1, some of this air flows through the impingement holes 59 of the second impingement rib 57, impinges the first impingement rib 56 and then flows through the impingement holes 58 thereof, then through the slots 45 and out the trailing edge 20 of the blade portion 24.

The flow path for the remaining air is through the second 41, third 42, fourth 43, and fifth 44 passage sections is series flow. As the cooling air flows through these sections, a portion is escaping through the side walls 14, 16 through cooling holes (not shown) that perforate the side walls 14, 16 along the length of the passage sections 40, 41, 42, 43, 44. The escaping cooling air provides both convective cooling and film cooling of the side walls 14, 16. Cooling air that does not escape through the cooling holes along the length of the second passageway system is dumped at the blade tip 26 through the second tip orifice 47.

Trip strips 80 are incorporated into the side walls 14, 16 along each passage section 40, 41, 42, 43, 44 to improve convective cooling. Each trip strip 80 produces downstream agitation or turbulence which effectively breaks up the boundary layers and causes the cooling air to scrub the walls of the passages. Further, the surface areas of the various passage walls are increased by the provision of trip strips with a resulting increase in fluid cooling efficiency.

Figure 3:
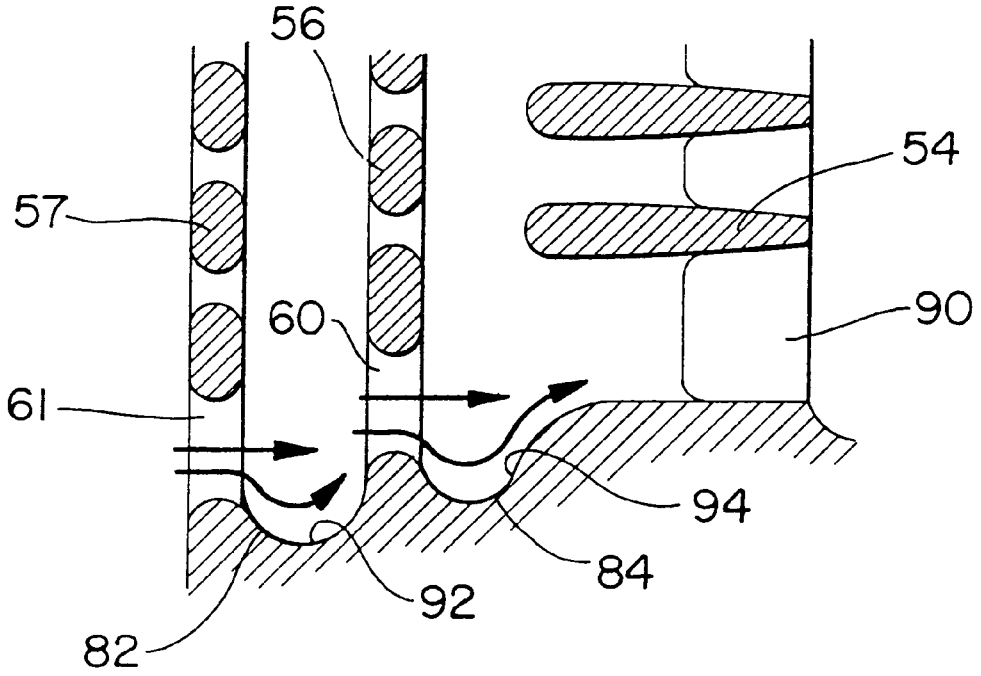
FIG. 3 is a somewhat enlarged fragmentary sectional view taken along the line 3—3 of FIG. 1.

As shown in FIG.3, the first root wall 82 includes a first recess 92 that extends toward the root end 33, and the second root wall 84 includes a second recess 94 that extends toward the root end 33. The root impingement hole 61 of the second impingement rib 57 is located a first distance 96 from the root end 33, and the root impingement hole 60 of the first impingement rib 56 is located a second distance 98 from the root end 33, and the first distance 96 is less than the second distance 98.

The first recess 92 forms a first curved surface that preferably has a cross section that defines a portion of a first circle, as shown in FIG. 3, that extends from the root impingement hole 61 of the second impingement rib 57 to the root impingement hole 60 of the first impingement rib 57. The second recess 94 forms a second curved surface that preferably has a cross section that defines a portion of a second circle, that extends from the root impingement hole 60 of the first impingement rib 56 to the root pedestal slot 90.

As those skilled in the art will readily appreciate, the cooling air flowing from the second root impingement hole 61 toward the first impingement rib 56 expands and accelerates into the first recess 92 due to the divergence provided by the circular cross section of the first recess 92. The cooling air then compresses and decelerates as it approaches the first root impingement hole 60 due to the convergence provided by the circular cross section of the first recess 92. As a consequence of this divergence and convergence, the centrifugal force acting upon the cooling air, which tends to force the cooling air toward the tip 26 of the blade 10, is insufficient to separate the cooling air flow from the first root wall 82 immediately adjacent the first root impingement hole 60. The cooling air therefore flows from the first recess 92 to the first root impingement hole 60, flows therethrough, and exits into the second recess 94.

The cooling air flowing from the first root impingement hole 60 toward the root pedestal slot 90 expands and accelerates into the second recess 94 and, due to the divergence provided by the circular cross section of the second recess 94, the cooling air then compresses and decelerates as it approaches the root pedestal slot 90. Again, the centrifugal force acting upon the cooling air, is insufficient to separate the cooling air flow from the second root wall 84 immediately adjacent the root pedestal slot 90, and so the cooling air therefore flows from the second recess 94 to the root pedestal slot 90, flows therethrough, and exits the blade 10 through the trailing edge 20.

An additional benefit of the shape of the recesses 92, 94 is that the recesses provide significantly more surface area for heat transfer than if the root walls 82, 84 were merely flat surfaces. This increased heat transfer, along with that provided by retaining a significant portion of the cooling air at or near the root walls 82, 84, provides sufficient heat transfer to prevent localized overheating of the blade 10 at the platform 28 on the trailing edge 20. As a result, the turbine blade of the present invention is less susceptible to fracture of the turbine blade 10 at the platform 28 immediately adjacent the trailing edge 20 than the turbine blades of the prior art.

Although this invention has been shown and described with respect to a detailed embodiment thereof, it will be understood by those skilled in the art that various changes in form and detail thereof may be made without departing from the spirit and scope of the claimed invention.

I claim:

1. A turbine blade having a hollow elongated body including a root portion at one end and a blade portion extending from said root portion and terminating at a tip at the other end of said body, said body having opposing side walls and longitudinally extending leading and trailing edges and having a plurality of generally longitudinally extending blade ribs therein extending between said side walls of the blade and plurality of generally longitudinally extending root ribs therein extending from said one end, said blade ribs and said root ribs partially defining a first fluid passageway system and a second fluid passageway system within said body, said first fluid passageway system distinctly separate from said second fluid passageway system, a first tip orifice opening through said other end and extending through said tip into said first fluid passageway system and a second tip orifice opening through said other end and extending through said tip into said second fluid passageway system, a first root rib extending from said one end toward said blade, a first blade rib extending from said tip end to said first root rib and integral therewith, said first fluid passageway system separated from said second fluid passageway system by said first root rib and said first blade rib, said passageway systems including a first passageway system having a substantially straight longitudinally extending first fluid passage opening through said one end and extending through said root portion into said blade portion and along said leading edge and terminating within said blade portion generally adjacent said tip end, said second fluid passageway system having a multiplepass fluid passage including a plurality of generally longitudinally extending and series connected passage sections defining a reversing flow path through the remainder of said blade portion, said passage sections including a first passage section in said blade portion extending along said trailing edge and a plurality of branch passages in said root portion opening through said one end and merging with each other and with said first passage section at a junction between said root and blade portions, said first passage section including first and second impingement ribs, and a plurality of pedestal slots that open through the trailing edge, each of said impingement ribs extending from said root portion toward said tip, said first impingement rib in spaced relation to said second impingement rib, each of the impingement ribs including a plurality of impingement holes for allowing air to pass therethrough, said impingement hole in each of said impingement ribs nearest said one end defining a root impingement hole, said pedestal slots defined by a longitudinally spaced series of elongated pedestal members disposed between the side walls, said pedestal slot nearest said one end defining a root pedestal slot, a first root wall extending between said root impingement hole of said second impingement rib and said root impingement hole of said first impingement rib, and a second root wall extending between said root impingement hole of said first impingement rib and said root pedestal slot, a second passage section adjacent said first section and connected thereto at a first outer turning region adjacent said tip end, said second passage section being separated from said first passage section and from said two branch passages by a second one of said blade ribs connected to said first root rib at said junction and extending toward said tip end in generally parallel relation to said first blade rib and terminating in spaced relation to said tip at said first outer turning region, a third passage section adjacent said second section and connected thereto at a first inner turning region proximate said junction, said third passage section being separated from said second passage section by a third one of said blade ribs extending from said tip toward said one end in generally parallel relation to said second blade rib and terminating in spaced relation to said first root rib at said first inner turning region, a fourth passage section adjacent said third section and connected thereto at a second outer turning region adjacent said tip end, said fourth passage section being separated from said third passage section by a fourth one of said blade ribs connected to said first root rib at said junction and extending toward said tip in generally parallel relation to said third blade rib and terminating in spaced relation to said tip at said second outer turning region, a fifth passage section adjacent said fourth section and connected thereto at a second inner turning region proximate said junction, said fifth passage section being separated from said fourth passage section by a fifth one of said blade ribs extending from said tip toward said one end in generally parallel relation to said fourth blade rib and terminating in spaced relation to said first root rib at said second inner turning region, said fifth passage section terminating within said blade portion and adjacent said tip, wherein said first root wall includes a first recess that extends toward said one end, and said second root wall includes a second recess that extends toward said one end.

2. The turbine blade of claim 1 wherein the root impingement hole of said second impingement rib is located a first distance from said one end, said root impingement hole of said first impingement rib is located a second distance from said one end, and said first distance is less than said second distance.

3. The turbine blade of claim 2 wherein said first recess includes a first curved surface that extends from said root impingement hole of said second impingement rib to said root impingement hole of said first impingement rib, and said second recess includes a second curved surface that extends from said root impingement hole of said first impingement rib to said root pedestal slot.

4. The turbine blade of claim 3 wherein said first smooth, curved surface has a cross section that defines a portion of a first circle, and said second smooth, curved surface has a cross section that defines a portion of a circle.

* * * * *